United States Patent [19]

Arato

[11] 4,285,736

[45] Aug. 25, 1981

[54] METHOD FOR WASHING BY MEANS OF A ROTATING WASHING EQUIPMENT, AND WASHING DEVICE FOR THE PRACTICE OF THE METHOD

[76] Inventor: Laszlo Arato, Seebuchtstr. 19, CH-6374 Buochs, Switzerland

[21] Appl. No.: 54,444

[22] Filed: Jul. 3, 1979

Related U.S. Application Data

[63] Continuation of Ser. No. 859,237, Dec. 9, 1977, abandoned.

[30] Foreign Application Priority Data

Dec. 17, 1976 [CH] Switzerland ..... 15900/76

[51] Int. Cl.[3] ..... B08B 7/00

[52] U.S. Cl. ..... 134/6; 15/50 C; 15/53 A; 15/DIG. 2; 134/29; 401/197

[58] Field of Search ..... 134/6, 29, 34, 176, 134/181, 180, 179; 401/137, 197, 274, 281, 284, 289; 15/24, 50 C, DIG. 2, 53 A, 53 AB

[56] References Cited

U.S. PATENT DOCUMENTS

| | | | |
|---|---|---|---|
| 2,636,198 | 4/1953 | Wilson | 15/53 A |
| 3,099,852 | 8/1963 | Grant | 15/24 |
| 3,436,161 | 4/1969 | Charos | 401/197 X |
| 3,872,533 | 3/1975 | Proffit | 15/24 |

FOREIGN PATENT DOCUMENTS

| | | | |
|---|---|---|---|
| 822859 | 9/1969 | Canada | 401/197 |

*Primary Examiner*—S. Leon Bashore
*Assistant Examiner*—Michael Goldman
*Attorney, Agent, or Firm*—Darby & Darby

[57] ABSTRACT

A method and apparatus for washing the surface of an object in which a rotating brush is provided. The bristles of the brush are supplied with a washing liquid through a hollow shaft for a limited angular rotation so that the washing liquid effectively is transmitted to the ends of the bristles substantially only during the time they make contact with the surface.

17 Claims, 4 Drawing Figures

METHOD FOR WASHING BY MEANS OF A ROTATING WASHING EQUIPMENT, AND WASHING DEVICE FOR THE PRACTICE OF THE METHOD

This is a continuation of my copending application Ser. No. 859,237, filed Dec. 9, 1977, now abandoned.

When washing with a rotating washing equipment, e.g. a cylinder brush, it is known that dry contact with the surface to be washed must be prevented. Otherwise, the bristles or the equipment surface would burn off due to frictional heat and the surface to be washed would be damaged. For this reason it has until now been customary to supply to the washing zone, e.g. through nozzles, a quantity of wash liquid, such as a soap or detergent, sufficient that excess liquid is hurled away from the equipment surface, in part by centrifugal force, while another portion of the liquid flows off along the surface to be washed. This requires a correspondingly large detergent supply and consumption, so that in the region of the object to be washed, e.g. an airplane, a conduit system and devices for the preparation of the detergent liquid must be present.

It is an object of the present invention to provide a method and apparatus which, while consuming relatively little detergent liquid, makes good cleaning possible. In accordance with the invention, a method and apparatus for washing by means of a rotating washing equipment is provided in which the detergent is supplied to the rotating part of the washing equipment to be wetted through a hollow shaft forming its axis of rotation, during a limited angle of rotation of each revolution of the equipment. In this way only the part of the peripheral area of the washing equipment in contact with the surface to be cleaned, or a limited other part of the peripheral area, is wetted intensely, so that liquid hurled away from the peripheral area of the rotating equipment impinges only on the surface to be cleaned.

In a preferred embodiment of the method and apparatus, the rotating part of the washing equipment is rotated in a direction so that the part of its peripheral area turned toward the surface to be washed moves counter to the direction of movement of the equipment along the surface of the object being washed, the limited angular region beginning in the direction of rotation before the contact point of the peripheral area of the washing equipment with the surface to be washed. In this way the liquid hurled away from the peripheral area of the rotating washing equipment portion will impinge only on the surface to be washed and will wet the latter before the washing action takes place by contact of the washing equipment.

To further prevent liquid from being hurled away from the peripheral part of the surface of the washing equipment, which in rotational direction follows the contact point, in a direction in which it does not impinge on the surface to be cleaned or already cleaned, the angular region of supply advantageously ends somewhat before the contact point of the washing device stops.

In accordance with the invention, there is further provided a washing device with a rotating cylindrical washing equipment which by means of a setting mechanism is movable relatively along the surface of the object to be washed. The washing equipment has a hollow shaft on which is mounted a rotating outer part of the equipment and a supply line for detergent opens into the hollow shaft. At least one outlet channel extends radially through the shaft bearing, so that the outlet channel comprises a stationary and a rotating radially directed portion, which portions are movable past each other through a limited angular region, through which their passage cross sections coincide at least in part and thus permit discharge of liquid over a limited angle of rotation. By positioning the relatively fixed portion of the discharge channel, the position of the angular region in which discharge of liquid occurs is determined. The size of the angular region is determined by the size, measured in circumferential direction, of the exit cross section of the stationary part of the radial exit channel and by the size of the entrance cross section moving past it of the rotating portion of the exit channel.

In the following, the invention will be described in greater detail with reference to an embodiment illustrated in the drawings, in which.

Figure 1:
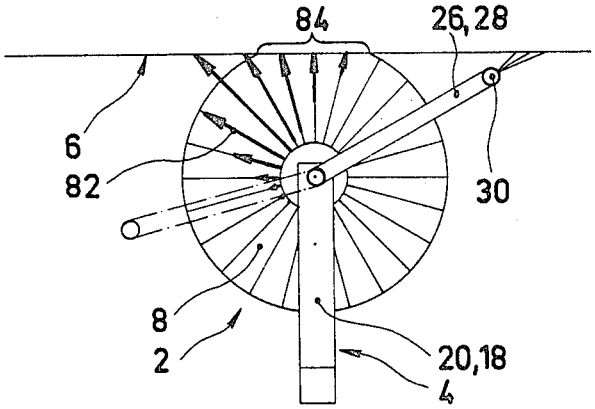
FIG. 1 is a schematic representation of a side view of a part of a washing device.
Figure 2:
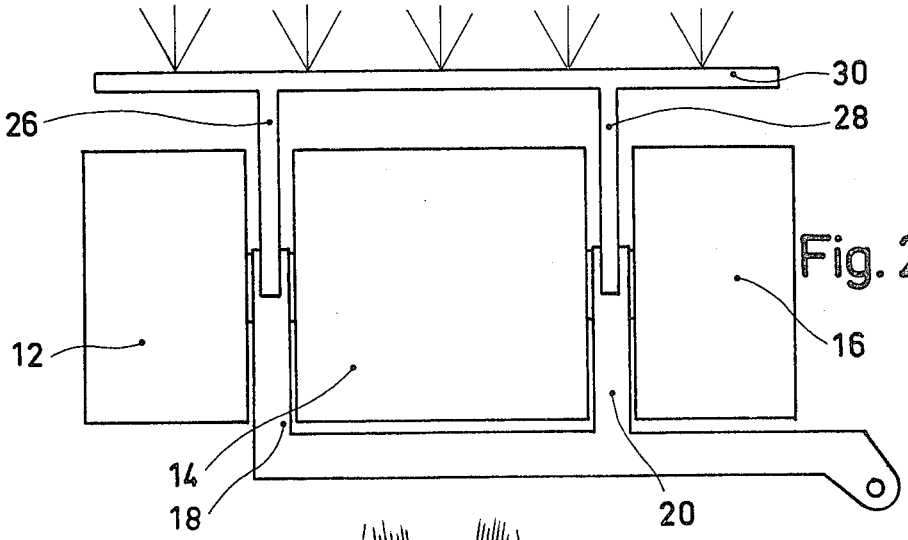
FIG. 2 is a schematic representation of a top view of the device of FIG. 1.

The washing device shown may be part of a washing installation for large-size objects, such as aircraft. Accordingly, the washing equipment 2 is held by the linkage 4 of a position-setting mechanism whereby the washing equipment can be moved automatically or program-controlled along the surface 6 to be washed. The contact pressure, or "depth of immersion," of the elastic and water-permeable washing unit 8, which is provided at the periphery of the washing equipment 2 and which preferably consists of an arrangement of numerous bristle bundles 10, may be controlled by means of sensors which take their bearings on the surface to be washed. These sensors, not shown in the drawings, may be arranged in gaps 11 (FIG. 3) between individual cylindrical washing unit elements 12, 14, 16 (FIG. 2) as well as at the outer ends of the washing equipment 2. Between these gaps 11, of which there are two as shown in FIG. 2, there extend two fork arms 18, 20 for holding the washing unit elements 12, 14, 16, which arms are part of the linkage 4 of the setting mechanism. Arms 18, 20 also carry the supply lines 22, 24, leading from the outside toward the interior of the equipment, for the detergent liquid, flush water, and for the energy connection to the element drive motor(s) (not shown). Further there extend outwardly through these gaps 11 two flush water lines 26, 28 to a pivotable flushing rake or spray line 30, which extends parallel to the axis of rotation of the washing equipment 2 and is arranged in the direction of movement behind the equipment 2, to flush the detergent off the surface 6 according to the representation in FIG. 1. The pivotability of rake 30 permits optimum adaptation to the washing process and to the contour of the surface to be washed.

Figure 3:
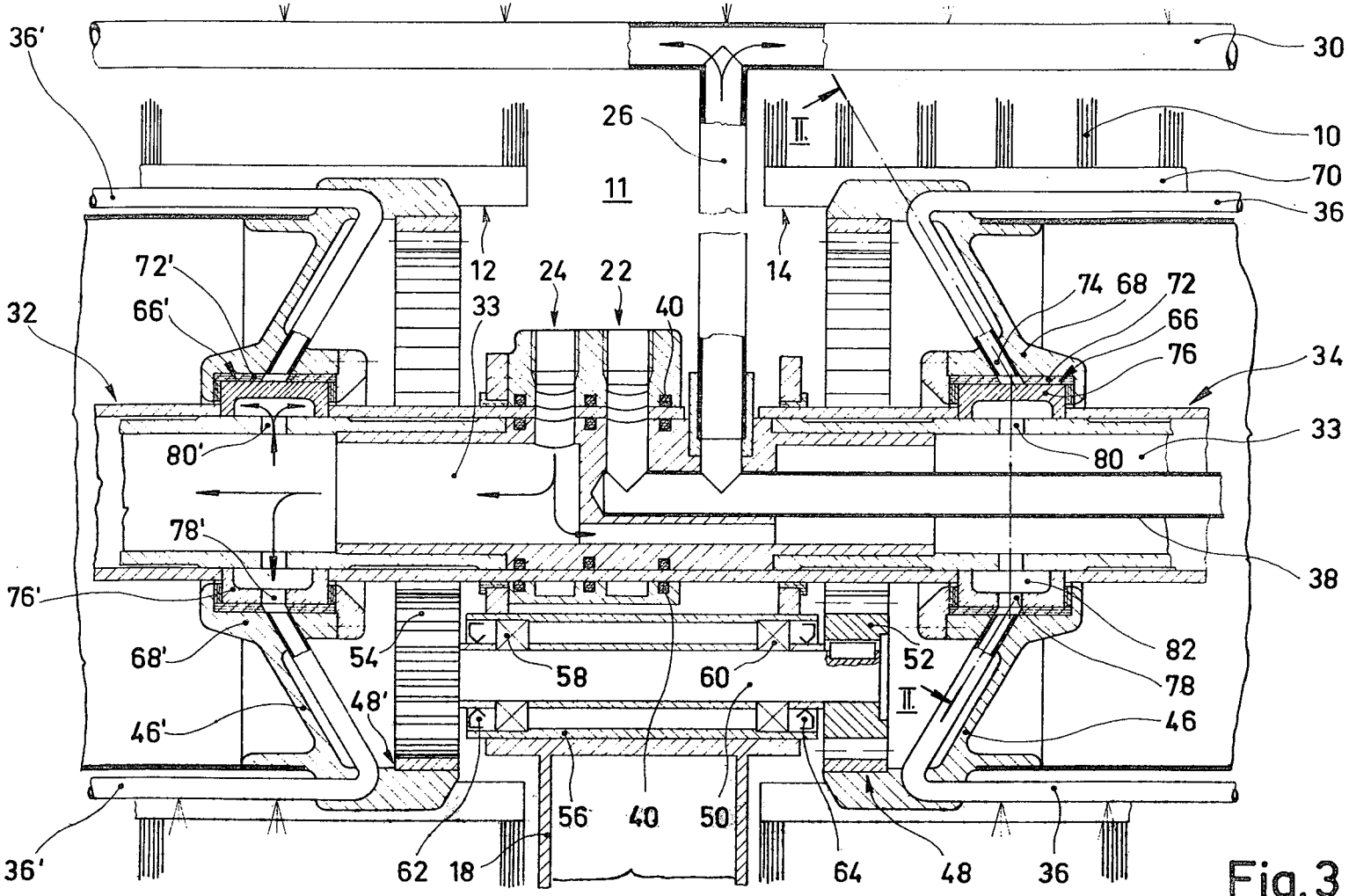
FIG. 3 is an axial section through a part of the washing equipment.

The washing equipment 2 has three hollow shaft parts of which only two, 32, 34, are shown in FIG. 3. Each hollow shaft part serves for the suspension of one of the drivable washing unit elements 12, 14, 16, as well as for the supply of detergent liquid radially outward to the spray lines 36, of which there is one, for example, between each pair of rows of bristle bundles 10, extending in the axial direction. In addition, the central hollow shaft part 34 carries flush water admitted through the supply line 22 to the two radially outwardly extending flush water lines 26, 28 of rake 30 (FIG. 2). Accordingly, the flow of detergent liquid starts from the feed line or connection piece 24 and passes through the annular hollow cross section 33 between the inner wall of hollow shaft part 34 and the outer wall of the flush water distributing line 38.

Due to the rotatable suspension of the distributing line 38 in the hollow shaft 34, by means of liquid-proof bearings 40, the spray rake 30 can, depending on the point of application of the washing equipment 2 or the form of the object to be washed, be pivoted with its two feed lines or flush water lines 26, 28 about the fixed hollow shaft 34 or relative to the retention arms 18, 20 into a position optimal for flushing. To make this pivoting movement possible, the supply line for the flush water connected at the connecting piece 22 may be flexible, i.e. a hose.

Of the washing unit elements 12, 14, 16, only one is driven directly by a motor (not shown) which may be an electric, compressed air, or hydraulic motor. Its pinion, or the pinion of an interposed gear, engages in the inner rim provided, for example, at the periphery of the hub 46 of element 16. Similar inner rims 48, 48' exist at hubs 46, 46' of adjacent washing unit or equipment elements facing each other over the gap 11 of the washing equipment. A connecting shaft 50, at each of whose ends is a pinion 52, 54 engaging in the inner rim 48, 48', establishes, across gap 11, the drive connection from one washing unit element 14 to the other washing unit element 12. This connecting shaft is mounted in a housing 56, which is firmly connected with the retention arm 18. The seal from outside for the protection of the shaft bearings 58, 60 occurs through ordinary seal rings 62, 64. The mentioned drive motor (not shown) may be located at a corresponding point, like the illustrated connecting shaft, between two washing unit elements 14, 16 and thus carry two pinions on a common drive shaft.

Each washing unit element 12, 14, 16 is guided through two bearings 66, 66' on a fixed hollow shaft part 32, 34, each bearing being contained in the hub 68, 68' of the washing unit element, one in the area of each of the two ends of the cylindrical washing unit elements. The admission of detergent liquid radially outward from the hollow shaft part 32, 34 to the numerous spray lines 36, 36' at the cylindrical bristle holder 70 occurs through the two bearings 66 of each washing unit element and hence also across the hubs. For this purpose the bushing 72, 72', advantageously made of plastic, and the hub 68 have bores to form passage ports 74 in a number corresponding to the number of spray lines 36.

Figure 4:
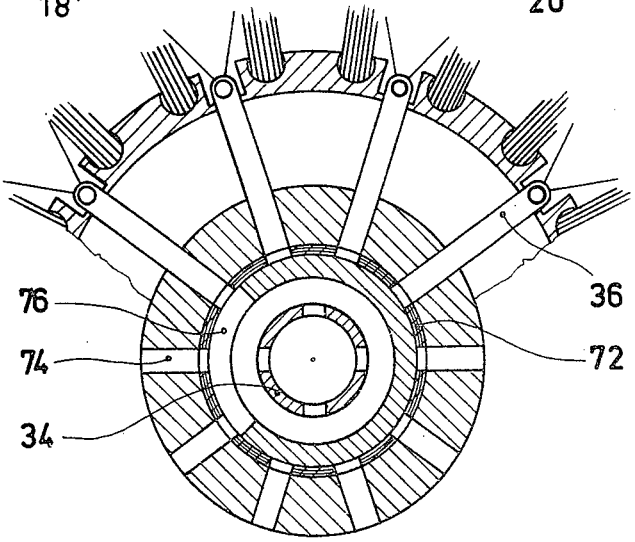
FIG. 4 is a transverse cross section along line II—II of FIG. 3.

These radial passage parts distributed on the circumference of the bearing bushing revolve about the fixed hollow shaft part, which in this region has, in a distributing ring 76, 76' a passage slot 78, 78' extending in a circumferential direction in a given angular region. The detergent liquid flows from the interior 33, 33' of the hollow shaft parts through two or more radial bores 80, 80' into the circumferentially extending space 82 of the distributor ring and thence via the passage slot 78, 78' into the passage parts 74, which during their revolving movement coincide with the passage slot. Since, as shown in FIG. 4, the passage slot extends only within a limited angular region only a limited circumferential region of the brush cylinder or washing unit element 12, 14, 16 is supplied with detergent liquid.

For the dimensions and arrangement of the passage slot 78, 78', it must be taken into consideration that the detergent liquid requires a certain amount of time to get from the region of the roots of the bristle bundles 10, in which the axially extending portion of the spray water line 36 is located, to the outer circumference of the brush cylinder, whence it is hurled away to the outside by centrifugal force. By a suitable arrangement of the passage slot, it is to be arranged that the hurled spray water can impinge only on the surface to be cleaned, so that it is pre-wetted until the brush cylinder comes in contact with it by its forward movement. In FIG. 1, the increasing and decreasing wetting of the bristle bundles in a circumferential direction under the influence of the centrifugal force is indicated by arrows 83. It is seen that in the longitudinal direction of the bristle bundles, the wetting increases from the center outwardly up to the contact region 84 of the bristles with the surface 6 to be cleaned, and thereafter decreases until no substantial amount of detergent liquid can be hurled away from the bristle bundles any more by the centrifugal force. In this way the washing process requires a minimum of detergent liquid and accordingly also the sewage system is burdened little. Naturally, a comparable effect can be obtained also with other rotating washing equipments, e.g. with a washing unit of water-permeable foam plastic.

What is claimed is:

1. A method for washing a surface with a washing device having cleaning bristles which rotate about a hollow shaft comprising the steps of moving the washing device in a first direction relative to the surface to be washed, contacting said surface with the bristles, rotating the washing device relative to said surface in a direction counter to said first direction at the area of contact with said surface, providing a washing liquid, and supplying the washing liquid from said hollow shaft to the rotating washing device only during a limited angle of rotation of each revolution of the device said angle ending just prior to the contact area between the bristles and the surface so that substantially all the washing liquid ejected from the device moves toward said surface.

2. A method as in claim 1 wherein said limited angle of supply of the washing liquid to the device begins before the contact point of the device with the surface being washed.

3. A method as in claim 1 wherein the step of supplying the washing liquid to the rotating device comprises rotating the device at a speed such that the washing liquid moves by centrifugal force through the washing device and bristles to the surface prior to and during contact of the bristles with the surface and discontinuing the movement of the washing liquid to the surface at the time each portion of the washing device leaves the surface.

4. A method as in claim 1 wherein the step of supplying the washing liquid comprises supplying the liquid to each portion of the device for movement through the device at a time such that the liquid makes contact with the surface only during a time just prior to and during contact of the bristles with the surface.

5. Apparatus for washing a surface comprising:

washing means having rotatable cleaning bristles to contact the surface;

means for rotating said washing means comprising a hollow shaft;

means for supplying a washing liquid to said washing means through said hollow shaft during a limited angle of each revolution of its rotation such that said washing liquid is ejected toward the surface only on one side of and throughout the contact area between the bristles and the surface;

an elongated flushing spray line;

means for mounting said flushing spray line generally parallel to said hollow shaft; and means for supplying flushing liquid through the hollow shaft to the flushing spray line to impinge on the surface on the other side of said contact area.

6. Apparatus as in claim 5 wherein said means for mounting the flushing spray line permits the spray line to be pivoted relative to the shaft.

7. Apparatus as in claim 5 further comprising means for mounting said washing means, hollow shaft and flushing spray line as a unit, and means for pivoting said unit about the normal axis of the hollow shaft.

8. Apparatus for washing a surface comprising:

washing means having rotatable cleaning bristles to contact the surface, said washing means comprising at least one generally cylindrical unit;

means for rotating said washing means comprising a hollow shaft;

means for mounting said at least one unit generally parallel to the axis of said hollow shaft; and means for supplying a washing liquid to said washing means through said hollow shaft during a limited angle of each revolution of its rotation, said angle ending just prior to the contact area between the bristles and the surface such that substantially all the liquid ejected from the washing means impinges upon the surface only on one side of and throughout said contact area.

9. Apparatus as in claim 8 wherein the means for mounting said at least one unit includes a pair of arms extending from a common member, said washing liquid supply means for the hollow shaft extending through said common member and one of said arms.

10. Apparatus as in claim 9 further comprising an elongated flushing spray line, means for mounting said flushing spray line generally parallel to said hollow shaft, and means for supplying flushing liquid through the hollow shaft to the flushing spray line.

11. Apparatus as in claim 10 wherein the supply means for the flushing liquid extends through said hollow shaft.

12. Apparatus as in claim 8 wherein said means for rotating said at least one unit forming said washing means comprises gear means adapted to be engaged by a driving gear.

13. Apparatus as in claim 12 wherein said at least one unit fits over said hollow shaft and the gear means of said at least one unit extends around said hollow shaft.

14. An apparatus for washing a surface comprising: washing means having cleaning bristles which rotate about a hollow shaft to contact the surface, means for moving the washing means in a first direction relative to the surface to be washed, means for rotating the washing means in a direction counter to said first direction at the area of contact between the bristles and the surface, means for providing a washing liquid, and means for supplying the washing liquid from said hollow shaft to the rotating washing means only during a limited angle of rotation of each revolution of the washing means, said angle ending just prior to the contact area between the bristles and the surface such that said liquid impinges upon the surface only ahead of and throughout said contact area.

15. Apparatus as in claim 1 wherein said liquid-supplying means further comprises a fixed means on said shaft having an opening communicating with the interior of the shaft to receive the washing liquid and an opening to discharge the liquid, first means mounted to and rotatable with said washing means opposite said fixed means and having an opening communicating with the discharge opening of said fixed means, said opening of said first and said opening of said fixed means providing flow of the washing liquid to the washing means over a limited angle.

16. Apparatus as in claim 15 wherein the inlet opening of the fixed means to the shaft is radial of the shaft.

17. Apparatus for washing a surface comprising:

a washing device having a rotatable brush to contact the surface;

means for moving the brush in a first direction relative to the surface to be washed;

means for rotating the device relative to said surface in a direction counter to said first direction at the area of contact between the brush and the surface;

means for introducing separate washing and flushing fluids substantially concentrically within the rotary brush, said washing fluid being supplied to the rotating device only during a limited angle of rotation of each revolution of the device and on one side of and throughout the contact area between the brush and the surface, said flushing fluid being substantially continuously sprayed on the surface on the other side of the contact area between the brush and the surface.

* * * * *